United States Patent [19]

Steeves et al.

[11] Patent Number: 4,630,766

[45] Date of Patent: Dec. 23, 1986

[54] FASTENER DRIVING APPARATUS AND METHODS AND FASTENER SUPPLY

[75] Inventors: Jay M. Steeves; Gilbert A. Cotta, both of Cincinnati, Ohio

[73] Assignee: Senco Products, Inc., Cincinnati, Ohio

[21] Appl. No.: 499,862

[22] Filed: Jun. 1, 1983

[51] Int. Cl.[4] ..... B21J 15/28

[52] U.S. Cl. ..... 227/8; 29/254; 227/113; 227/130; 227/136

[58] Field of Search ..... 29/230, 254, 566.1; 227/DIG. 1, 19, 43, 113, 130, 135, 136, 141, 148

[56] References Cited

U.S. PATENT DOCUMENTS

| | | | |
|---|---|---|---|
| 2,596,871 | 5/1952 | Schuldt | 10/155 |
| 2,637,230 | 5/1953 | Tinnerman et al. | 81/3 |
| 2,646,714 | 7/1953 | Tinnerman et al. | 85/36 |
| 2,908,908 | 10/1959 | Steinmetz et al. | 227/135 X |
| 3,472,366 | 10/1969 | Ackerman | 206/56 |
| 3,477,629 | 11/1969 | Becht | 227/130 |
| 3,543,634 | 12/1970 | Allen | 85/36 |
| 3,567,015 | 3/1971 | Colechia | 206/56 |
| 3,624,867 | 12/1971 | Reynolds | 24/73 PF |
| 3,704,507 | 12/1972 | Grube | 29/417 |
| 3,711,931 | 1/1972 | Ladouceur et al. | 29/412 |
| 3,774,756 | 11/1973 | Carlile et al. | 206/56 AB |
| 3,999,659 | 12/1976 | Grube | 206/343 |
| 4,121,487 | 10/1978 | Bone | 83/23 |
| 4,179,057 | 12/1979 | Becht et al. | 227/19 |
| 4,194,664 | 3/1980 | Siegmann | 227/8 |
| 4,279,341 | 7/1981 | Pelickhardt | 206/345 |
| 4,294,391 | 10/1981 | Obergfell | 227/130 |
| 4,306,654 | 12/1981 | Grube | 206/343 |
| 4,341,303 | 7/1982 | Britt | 206/343 |
| 4,364,507 | 12/1982 | Savino | 227/19 X |
| 4,424,929 | 1/1984 | Weis | 227/43 X |
| 4,463,888 | 8/1984 | Geist et al. | 227/113 X |

FOREIGN PATENT DOCUMENTS

| | | | |
|---|---|---|---|
| 68533 | 7/1951 | Netherlands | 227/113 |

*Primary Examiner*—Paul A. Bell

*Attorney, Agent, or Firm*—Wood, Herron & Evans

[57] ABSTRACT

A fastener supply includes a collated strip of fasteners having laterally extending ears. The fasteners are held together by spaced, parallel, preferably flexible elongated carrier strips, adhered to the ears. A magazine feeds fasteners to an inclined or tilted position in a drive station of a fastener driving gun. The apparatus is manipulated over a lug so that the lug extends through a fastener to be driven and engages a locating surface for gun and fastener alignment. Fasteners are rotated, as they are driven, from the inclined to a perpendicular position with respect to the lug. Methods of driving are included.

18 Claims, 11 Drawing Figures

FASTENER DRIVING APPARATUS AND METHODS AND FASTENER SUPPLY

This invention relates to apparatus and methods for applying fasteners, and to a fastener supply therefor. More particularly, this invention relates to apparatus for applying fasteners to receiving lugs in order to secure various elements to such lugs. Also, the invention relates to a collated fastener supply for use in the applying apparatus.

In many instances, it is common to utilize fasteners of the speed nut or spring clip variety to secure a panel or other element on a fastener stud, lug or post. Such a clip and application is shown, for example, in U.S. Pat. No. 2,646,714.

Despite that patent disclosure of an air operated device for applying spring nuts, it remains common, in many fields, to apply individual clip fasteners to posts or lugs by manually locating the clips on the posts and hammering them thereon. Manual operations continue to be used, because known air operated devices for doing this involve a number of disadvantages. For example, where the fastener clip or nut is held in the device, it is difficult to locate the fastener with respect to its receiving member, such as a lug or post. Moreover, it is difficult to accurately position the device so the fasteners are precisely aligned with the receiving lug or post just before and during the driving application.

The fasteners and the way they are supplied to and held in the apparatus also constitute a major consideration in the automatic driving of fasteners onto receiving members. Where the fasteners are joined together by severable integral bridging material, for example, they must be severed when applied, either as mentioned in the aforesaid patent, or by hand. This requires extra working effort and operation at the point of fastener application, unduly complicating the process and equipment. Alternatively, it is known to join by separate elongated wires, for example, and the fasteners separated from the wires or from each other by some means at the point of application. Otherwise, separate fasteners could be collectively supplied and used, but this lends to fastener loss, disorientation or other loss of control.

If the fasteners are secured together, the material attaching the fasteners must be handled so that it does not interfere with the driving element, as it engages and drives the next fastener. As suggested, the material can be severed upon application, or prior to application. In the first instance, however, the necessity of severance adds to design difficulties. In the second instance, the loose, severed individual fasteners may be much more difficult to control between the time they are severed, and the time they are driven.

Accordingly, it has been one objective of this invention to provide an improved fastener applying apparatus and an improved fastener supply therefor.

Another objective of the invention has been to provide a fastener applying apparatus and a collated strip of fasteners therefor where the fasteners are attached together until each is driven, but no severance of bridging or other joining material is required.

Another objective of this invention has been to provide a powered fastener applying apparatus and means for positively and consistently orienting the apparatus and a fastener to be applied with a fastener receiving member.

A further objective of the invention has been to provide an improved fastener driving apparatus with a safety to prevent firing until the apparatus is positioned on an element to be fastened.

A further objective of this invention has been to provide improved fastener applying apparatus and fastener supply such that fasteners of the various shapes can be used.

A still further objective of the invention has been to provide an improved fastener supply.

A yet further objective of the invention has been to provide an improved fastener supply where fasteners are releasably joined together, but do not require mechanical or manual severance of any elongated fastener joining elements when the fasteners are driven.

To these ends, a preferred embodiment of the invention includes an improved fastener applying gun and an improved fastener supply wherein spring clip fasteners having side or lateral ear portions are releasably joined seriatim by means of two elongated, parallel, adhesive carrier strips engaging the side ears and extending laterally outwardly thereof on each fastener side. The clips are secured by, and slide along, guide rails within a fastener gun magazine which is disposed at an acute angle with respect to the reciprocal motion of a fastener driver or ram in the gun. As the fasteners are fed to an inclined position at a drive station or position beneath the driver, the forward fastener runs beyond the magazine guide rails and the carrier strips are engaged and guided by a second set of guide rails outwardly of the fasteners' ears. No guides interfere with the fastener drive path at the drive station. When the fastener is driven, it is simply pushed away from the adhesive on the guide-supported carrier strips. These strips extend progressively forwardly out of the gun and are discarded after the last fastener is driven. The driver engages and drives the fastener without cutting or severing either carrier strip.

In order to provide for proper gun and fastener orientation, fasteners in the drive position are inclined at a angle of about 15° from horizontal (assuming that the driver motion is perpendicular). The fastener opening is preferably elongated and of such dimension to accommodate, at one end, the forward corner of a lug to which the fastener is to be applied. With the fastener in an initially inclined position, the gun is manipulated over the fastener receiving lug until the lug extends through the clip opening and engages a locating element in the gun above the clip, thus aligning the gun to the lug, as well as the fastener to the lug. Thereafter, the gun is fired, the driver face first engaging the rear portion of the clip to rotate it through the incline angle to a perpendicular (flat) position with respect to the receiving lug.

To facilitate location of the lug, and proper gun orientation, a guide foot extends downwardly from the gun rearwardly of the drive station. The foot includes a slotted reference surface, substantially perpendicular to the direction of driver reciprocation, for engagement with an element to be secured to the receiving lug. When the reference surface engages the element flush, the gun is preferably in a proper vertical position for firing, assuming the lug has been located through the clip as described above. Moreover, clips or fasteners in the magazine are visible for counting through the slot in the reference surface and through a cooperating elongated slot in the magazine bottom.

A sliding trigger block safety depends beneath the magazine, preferably within the guide foot, and is depressed to clear the trigger when the guide foot is pressed against an element to be fastened.

The inclined magazine, together with the inclined disposition of the to-be-driven fasteners at the drive position, provides several unique and unexpected advantages. These include, first, the upwardly inclined magazine and slotted foot which together permit versatility and freedom of gun movement while the apparatus is manipulated into proper position, and promote proper gun and driver alignment with a fastener receiving post. Secondly, the tilted fastener clip permits a corner of the receiving lug or post to extend into the gun against a locating edge to insure proper gun, fastener and lug alignment before firing.

The fastener supply provides a collated strip of fasteners which are releasably secured together for handling and loading, yet which does not require mechanical or manual severance of elements as the fasteners are applied. The carrier strip may be used to carry fasteners or other to-be-applied elements of various shapes and sizes, within one or more gun/magazine/driver configurations.

These and other advantages will become readily apparent from the following detailed description of a preferred embodiment, and from the drawings in which.

Figure 1:
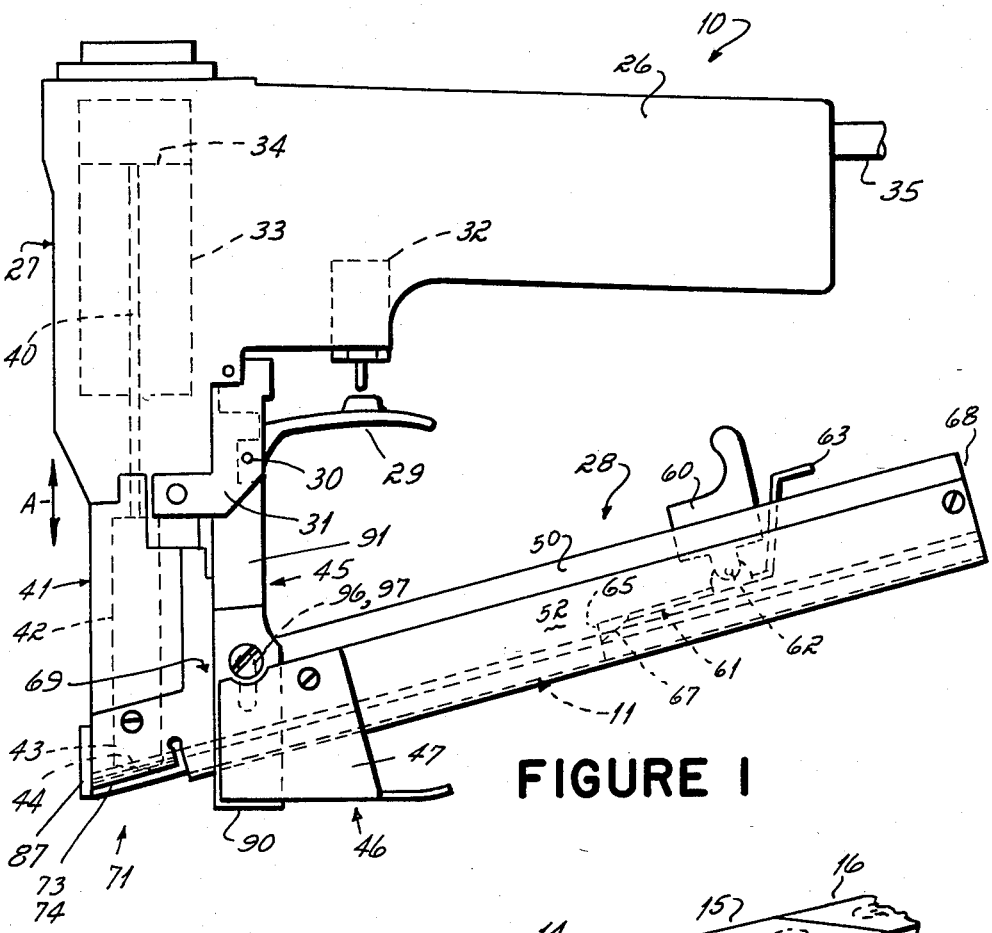
FIG. 1 is an elevational view of a fastener gun according to a preferred embodiment of the invention.

Turning now to the drawings, there is shown in FIG. 1 a fastener driving apparatus 10 according to a preferred embodiment of the invention. As hereinafter described, the fastener driving apparatus 10 is particularly useful for applying fasteners of the spring clip variety to fastener receiving lugs or posts for the purpose of securing an element, such as a panel, onto the posts or member from which the posts extend. It will be appreciated that the fastener apparatus 10 can as well be utilized in the application of other types of fasteners, or elements, onto receiving members for other various uses and purposes.

Figure 2:
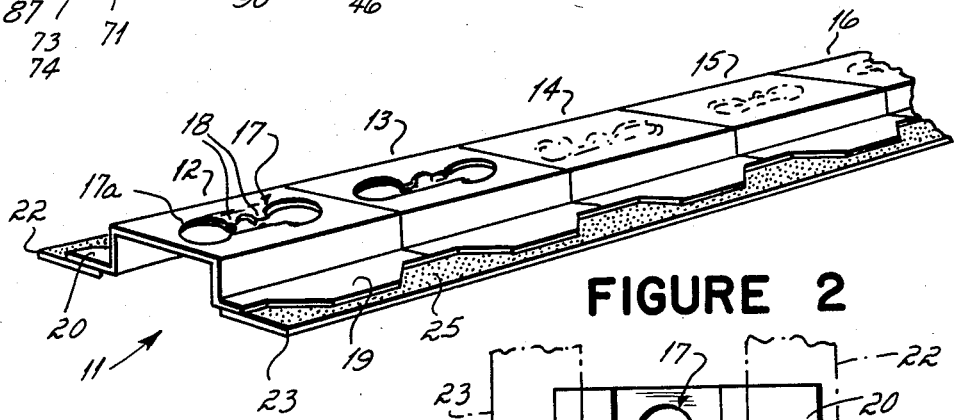
FIG. 2 is a perspective view of a collated strip of fasteners according to a preferred embodiment of the invention, shown in inverted-from-use position.

FIG. 2 of the drawings depicts a collated strip 11 of fasteners according to a preferred embodiment of the invention. As shown, strip 11 includes fasteners, 12 through 16, aligned front to rear in serial fashion. In accordance with the preferred embodiment of the invention, each of these fasteners is similar. Each fastener includes a spring clip opening 17 defined in part by spring fingers 18 which are bent inwardly or downwardly as shown in FIG. 2. These fingers are opposed across the opening 17 and have edges spaced apart a distance slightly smaller than the thickness of a predetermined post or receiving lug over which the fasteners are to be used.

Figure 3:
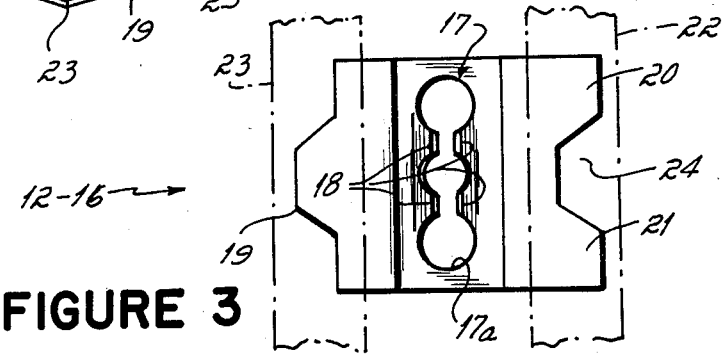
FIG. 3 is a top plan view of a fastener as used with a preferred embodiment of the invention, and looking down on the fastener, as it is disposed in the apparatus of FIG. 1, from above.

As shown in FIG. 3, the fastener 12 also includes at least one ear 19 on one side edge of the fastener and extending laterally and outwardly therefrom. Preferably, further ears 20 and 21 are disposed on an opposite side of the fastener, extending laterally and outwardly therefrom. It will be noticed, particularly from FIG. 2, that the opening 17 lies in a plane which is generally spaced from the plane in which the ears 19, 20 and 21 reside. This particular fastener is disclosed herein for purposes of illustration, and the particular fastener configuration itself does not comprise any part of this invention.

The fasteners 12 through 16, and others if desired, are held seriatim by means of elongated, parallel, preferably flexible carrier strips 22 and 23. Preferably, such carrier strips comprise flexible adhesive tape, adhesively secured to the ears of the respective fasteners. These strips are shown in phantom in FIG. 3 in a position where they overlap the ears 19 through 21, respectively. Specifically, the carrier strips extend outwardly of the side edges of the fastener and outwardly of the ears. It will be noted from FIGS. 2 and 3 that there are gaps in or between the ears. Such gaps are shown, for example, at 24 in FIG. 3 and at 25 in FIG. 2. In these areas the adhesive tapes or carrier strips 22 and 23 are adhesively desensitized, preferably after the strips have been applied to the fasteners, so that the adhesive surfaces of the strips do not pick up foreign matter. Such desensitization can be performed chemically or by masking or by any other suitable processes such as, for example, by spraying the strips and the gap areas with powder to effectively render the exposed strip surfaces non-tacky. Any suitable flexible tape and adhesive or other means for releasably securing the fasteners onto the tape can be utilized.

Even more particularly, one form of carrier which has been found useful is a flexible, pressure sensitive adhesive tape. Such a tape may comprise a flexible synthetic carrier and a pressure sensitive adhesive thereon, such as a tape produced by the Industrial Tape Division of the 3M Company of St. Paul, Minn. and identified as sample No. FES234.

It should also be recognized that while particular fasteners, as shown in FIGS. 2 and 3, are described herein, the invention contemplates the utilization of other shapes and sizes of fasteners which might be suitable for other types of fastening applications than that disclosed herein. Many fasteners and other types of elements to be applied to receiving members can be supplied with laterally extending ears for the purpose of securing the fasteners together by means of one or more carrier strips as disclosed herein to take advantage of the benefits of this invention.

Finally, and as noted in the description of the drawings, the fasteners, as shown in FIG. 2 for illustration purposes, have been turned over from the position in which the fasteners are utilized in the fastener appying apparatus 10. Accordingly, and in use, where the fasteners are to be applied to vertical posts or lugs, for example, the collated strip of fasteners may be turned over such that the openings 17 are below both the ears 19 through 21 and the strips 22 and 23.

Returning now to FIG. 1, the fastener applying apparatus 10 includes a pneumatically actuated fastener driving apparatus including a handle 26, a housing 27 and a fastener containing magazine 28. A trigger 29 is pivoted at pivot point 30 to a trigger bracket 31 mounted on the gun 10. The trigger 29 is disposed for the actuation of a pneumatic valve 32 to drive fasteners, as will be explained.

The housing 27 of the gun encloses a pneumatic expansion chamber 33 and a piston 34, selectively coupled by the actuating of the trigger 29 to a source of high pressure air provided to the gun at fitting 35 for the purpose of driving the piston downwardly.

A driver means for driving the fasteners includes a ram member 40 connected to the bottom of the piston 34 and extending downwardly from the housing 27 to and through the nose 41 of apparatus 10. The ram 40 is fitted to an enlarged ram or driver 42 guided in the nose and having a lower end 43 for engaging fasteners to be driven.

In addition to the elements already mentioned, the fastener driving apparatus 10 as shown in FIG. 1 also includes a trigger blocking safety 45 and a guide foot 46, all as will further be described.

The pneumatic fastener driving apparatus above the magazine is based on the pneumatic fastener apparatus disclosed in U.S. Pat. Nos. 3,477,629 and 4,194,664, incorporated herein by reference for illustration purposes. These patent disclose a pneumatic fastener applying device known as the "J-TOOL" manufactured by SENCO Products, Inc. of Cincinnati, Ohio. While the handle 26, housing portion 27, pneumatic valving 32, expansion chamber 33, and piston 40 are similar to that shown in this patent, other portions of the apparatus have been modified in accordance with this invention. These include, for example, modifications to nose 41 to accommodate the enlarged driver portion 42 of the ram, modifications to the lower end of the nose piece and the driving station, as will be described, modifications to the magazine and the use of a refashioned trigger, trigger bracket and safety for use with the tool.

Figure 4:
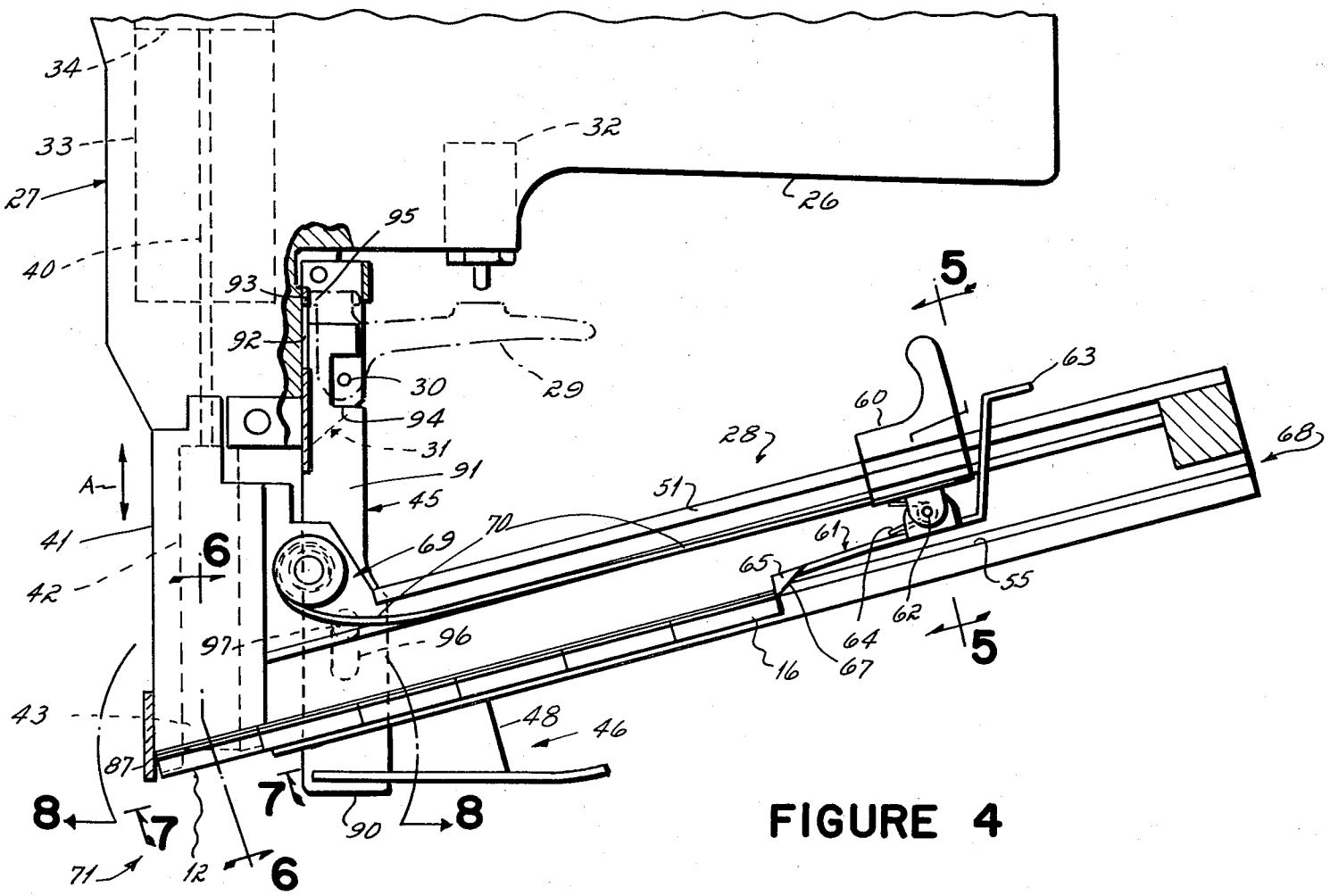
FIG. 4 is an enlarged broken and cut-away view of the gun of FIG. 1, broken to show enlarged details.
Figure 5:
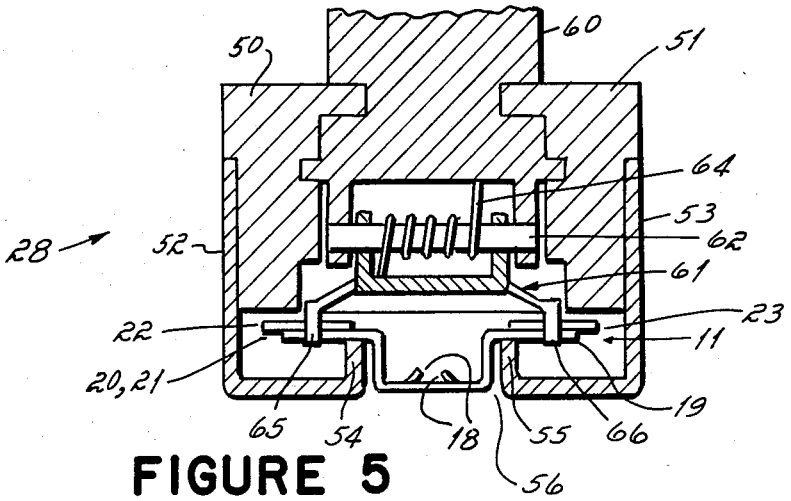
FIG. 5 is a cross-sectional view taken along line 5—5 of FIG. 4.

Turning now to a description of the lower nose portion of the gun and of the magazine, attention is directed to FIGS. 4–7. The magazine 28 is shown in cross-sectional view in FIG. 5. Magazine 28 includes two elongated frame members 50 and 51. Secured to the frame members, by screws or other means, are elongated fastener engaging guide rails 52 and 53 for engaging and guiding fasteners in the magazine. To this end, the guide rails have respective inwardly and upturned portions 54 and 55 for engaging the laterally extending portions or ears 20, 21 and 19, respectively, of the fasteners, as best seen in FIG. 5.

Slidably mounted in frames 50 and 52 is a magazine follower 60. A pusher 61 (FIG. 4) is pivoted at 62 to the follower 60. A handle 63 is provided for pivoting the pusher 61, against the bias of spring 64, upwardly as shown in FIG. 4. This selectively disengages the pusher 61 from the rearward most fastener, such as fastener 16, in the strip of fasteners disposed in the magazine 21. The pusher 61 has depending legs 65 and 66 extending downwardly in an interference pathway with respect to the fasteners located in the magazine 28 in order to engage and push them forwardly to a drive station 71 located beneath the housing 27 in nose 41.

As shown in FIG. 4, the rearward edges 67 of pusher 61 are inclined such that fasteners can be loaded from the rear end 68 of the magazine and pushed under the pusher 61 into position. Also, it will be appreciated that the pusher 61, once it reaches its forward most position in the magazine when the gun has exhausted its supply of fasteners, can be withdrawn rearwardly over the tops of newly inserted fasteners as a result of the inclined surfaces 67.

The follower 60 is connected to a forward spring housing portion 69 of the magazine 28 (which alternately may be a lower portion of the nose 41) by a flexible spring 70. This spring constantly biases the follower 60 and pusher 61 forwardly. Of course, when it is desired to unload fasteners from the gun, it is possible to depress the handle 63, thus raising the pusher legs 65 and 66 upwardly to permit the fasteners to be withdrawn rearwardly from the magazine.

In the preferred embodiment, the magazine guide rail members 52 and 53 extend toward the forward end of the apparatus. Nevertheless, the upturned guide engaging rail portions 54 and 55 terminate just short of the area disposed beneath the nose 41 at the drive station 71.

Extending forwardly of the upturned guides 54 and 55 are further elongated strip guides 73 and 74, respectively. Preferably, these guides are integral portions of the members 52 and 53, but are not continuations of guides 54 and 55. These guides 73 and 74 are disposed outwardly of the more inward position of upturned guides 54 and 55 so that they do not engage any laterally extending portion or ear of the fastener itself. Instead, and according to the invention, these guides slidably receive those portions of the carrier strips 22 and 23 which extend outwardly of the laterally extending side edges and ears of the fastener. Accordingly, and returning for a moment to FIG. 1, it will be appreciated that as the collated strip 11 moves through the magazine 28, the fasteners are first supported by riding directly on the upturned guides 54 and 55, extending respectively from the elongated guide members 52 and 53 (as shown in FIG. 5). At the drive station 71, however, the upturned guide rails 54 and 55 are discontinued and terminated, and the elongated drive station carrier strip engaging guides 73 and 74 continue from that point through the drive station 71. Accordingly, the fasteners make a transition between the magazine guides on the one hand and the drive station guides on the other, the important transition being from direct support of the fasteners on the magazine guides 54, 55 to the carrier strips riding on the elongated guides 73 and 74 (as shown in FIG. 6).

Figure 6:
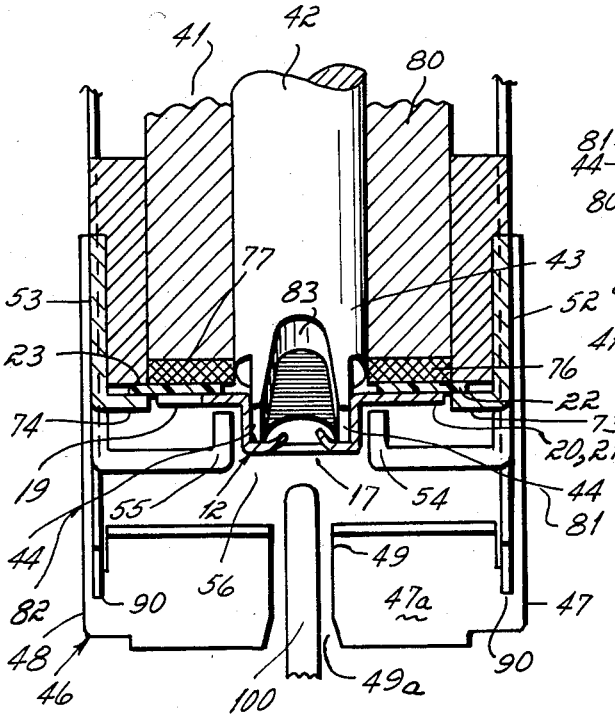
FIG. 6 is a cross-sectional view taken along line 6—6 of FIG. 4.
Figure 7:
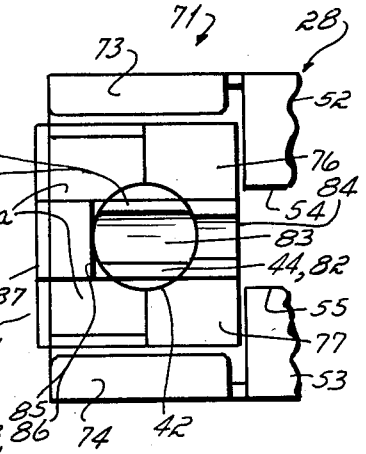
FIG. 7 is a bottom view of the driver station or set position taken along line 7—7 of FIG. 4.

Referring now to FIGS. 6 and 7, the drive station 71 is provided with magnets 76 and 77 for the purpose of releasably holding a fastener in the set or drive station 71 before driving. These magnets may supplement the holding of the fasteners at the drive station by carrier strips 22, 23.

Considering FIG. 6, it is noted that the upper edges of the upturned guides 54 and 55 of the magazine 28 hold the fasteners slightly lower than their position when they are in the drive station 71. Additionally, it is noted that the strip engaging guides 73 and 74 hold the strip upwardly in the drive station so that the strip slides between these guides and the lower surfaces of the nose portion or drive station 71 of the apparatus. Referring again to FIG. 7, it will be appreciated that the magnets 76 and 77 are located in the area at the beginning of the guides 73 and 74 and at the end of the upturned guides 54 and 55. Accordingly, as the fasteners move into the set or drive station 71, magnets 76 and 77 tend to attract the fasteners upwardly so that the strip 11 is drawn against the lower surfaces of the nose portion and the drive station, and above the guides 73, 74, in order that the fastener and the strips are positioned as shown in FIG. 6.

Considering now the structure of the lower nose portion of the apparatus and the drive station 71, it will be appreciated that the lowermost portion of nose 41 encompasses the enlarged driver ram 42. Specifically, the nose portion includes a sleeve 80 surrounding the enlarged circular ram end 42.

As shown in FIGS. 4 and 6–10, the enlarged driver ram 42 has, as its lower end 43, a fastener engaging face 44 configured for the purpose of engaging the fasteners and driving them onto a receiving member. Specifically, and perhaps as best seen in FIG. 7, the face 44 includes side portions 81 and 82 and a hollowed out central portion 83 to accommodate the upstanding portion of the fastener lug or post on which the fastener is to be driven. It will be appreciated that the side portions 81 and 82 are relatively flat and are perpendicular, from front to back, as viewed in FIGS. 8–10, with respect to the direction of reciprocation of the ram 42. This direction is shown by the arrows "A" in the various figures.

The drive station 71 thus has surfaces defined by faces 80*a* of the sleeve 80, and the magnets 76 and 77, which are at the lower ends of the sleeve 80. Also, it will be appreciated that the forward portion of the sleeve 80 terminates at an end which functions as a locating edge for the fastener receiving lug or post, as will be hereinafter described. In particular, the lower end of the sleeve 80, at the forward portion thereof, has an extended member 85 terminating in the transverse locating edge 86.

Figure 8:
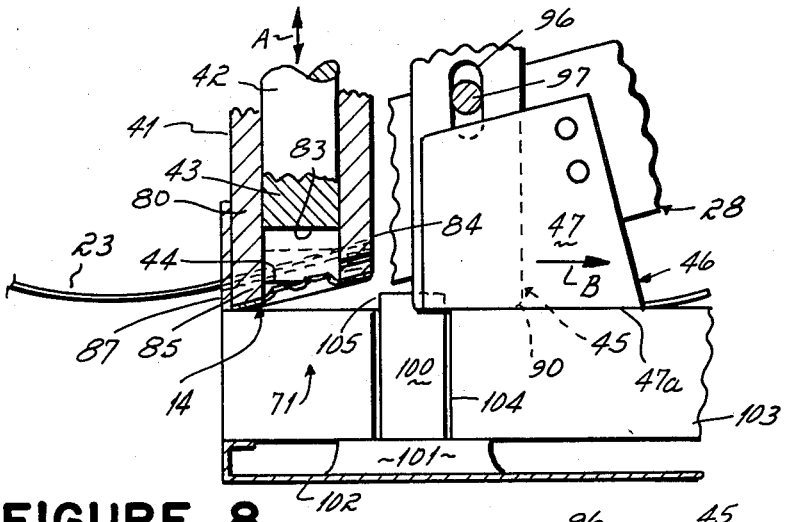
FIGS. 8–10 are enlarged cross-sectional views of the encircled areas on line 8—8 of FIG. 4, showing various respective operational stages of the apparatus of FIGS. 1 and 2.

At the lower end of the nose 41 is located a fastener stop comprising a plate 87. This extends downwardly into the path of the fasteners at the forward edge of the drive station 71. The relationship of the fastener stop to the face 85 and the locating edge 86 is such that as fasteners are moved into the drive station, the ears of the fasteners are accommodated beneath the faces 80*a* of the sleeve 80, while the extended portion 85 of the sleeve 80 extends further downwardly into the area of the fastener between the ears. Nevertheless, the forward edge of the fastener moves forwardly past the sleeve 80 until it engages the stop 87, perhaps as best seen in FIGS. 7 and 8. Accordingly, it will be appreciated that the fastener stop 87 engages the forward edge of the fasteners as they are fed to the drive station 71 and the locating edge 86 is disposed rearwardly of the stop into an area which is adjacent the opening 17 of the fasteners at the drive station. This edge is located in a position very close to the fastener opening for the purpose of locating a fastener receiving lug or post, as will hereinafter be described.

Located on the magazine 28 is a guide foot 46 which is secured to the magazine by screws or any other suitable means. The guide foot 46 is comprised of two half portions 47 and 48 defining between them a receptor slot 49 (FIGS. 6 and 11) in register with the slot 56 (FIGS. 6 and 11) defined between the upturned guides 54 and 55. These slots provide two purposes. First, the fasteners within the magazine can be viewed through the slot 49 and the slot 56 in order to permit counting of the fasteners or verification that the fasteners are loaded into the magazine. In addition, the slot 49 provides a reference slot, facilitating locating of an upstanding post or lug for receiving a fastener. It will be appreciated that the elements 47 and 48 have lower reference surfaces, such as at 47*a* in FIG. 8, for the purpose of engaging a member to be secured by the fastener and for providing means by which the apparatus can be appropriately aligned prior to fastener driving.

In addition, it will be appreciated that the reference surfaces of the elements 47 and 48, such as surface 47*a*, are disposed in a perpendicular direction with respect to the direction "A" of ram motion. Also, it will be appreciated that the guide foot 46 is located beneath the magazine 28 and rearwardly of the set or drive station 71.

The orientation of the magazine 28, the guide foot 46 and the nose 41 of the gun is shown in FIGS. 1 and 4. It will be appreciated that the ram or driver 42 reciprocates in the direction as indicated by the double arrow "A", shown in FIGS. 1 and 4. The magazine 28 is attached to the nose 41 of the gun at an acute angle with respect to the direction of movement "A" of the driver. Preferably, this acute included angle is approximately 75°. Accordingly, when the gun is held in an upright or vertical position, such as illustrated in FIG. 1, the magazine 28 forms an angle of about 75° with respect to the direction of driver movement "A" and is angled upwardly and away from the horizontal at approximately 15°. The reference surface of guide foot 46, such as illustrated at 47*a*, lies in a plane which is generally perpendicular to the direction of movement "A" of the driver ram 42. Accordingly, the magazine 28 is angled at approximately 15° to the plane defined by the reference surfaces of the guide foot 46.

In this connection, it will also be appreciated that the sleeve 80 enclosing the driver ram has a rearward terminal end 84 at which the magnets 76 and 77 are located. The rear end 84 of the sleeve 80 is disposed above the lower end 85 of the sleeve 80 at the forward portion of the nose 41. Accordingly, the ends 85 and 84 lie in a plane which is at an angle with respect to the direction of reciprocation, as indicated by the arrows "A". This relationship is best seen with reference to FIG. 9, for example.

Also, of course, the elongated guides 73 and 74 are also disposed at an acute angle of about 75° with respect to the direction of reciprocation "A" of the ram 42. Accordingly,, it will be appreciated that the fasteners in the drive station 71 are inclined with respect to the direction of reciprocation "A" of the ram just prior to driving. This inclined position of the fasteners is shown, for example, in FIGS. 8 and 9. Accordingly, it will be appreciated that the fasteners are contained in the magazine 28 at an acute angle with respect to the direction of reciprocation of the ram 42 and, as well, are fed to a set or drive station 71 where they are also inclined at approximately the same angle just prior to engagement by the ram 42 for driving them onto a fastener receiving lug or post.

The disposition of the fasteners at an acute angle with respect to the driver direction facilitates the proper orientation of the fastener driving gun and the fastener with respect to a fastener receiving lug or post, as will be described. This is accommodated by the fact that the inclination permits an enlarged portion 17*a*, of the opening 17 of the fasteners (FIG. 3), to be tilted downwardly into a lower position than the more restricted opening defined between the spring fingers 18 on each side of intermediate portions of the opening 17. This facilitates the accommodation of a fastener receiving lug or post into and through the end of the opening 17 prior to positive engagement of the post by the driven fastener. It will be appreciated that if the fastener was disposed in the set or drive station 71 in a generally perpendicular disposition with respect to the reciprocable direction "A" of the ram, it may be difficult to extend the fastener receiving post upwardly between the fingers 18 of a fastener a distance great enough to provide for orientation of the gun and the fastener with respect to the post, as will be hereinafter described.

The fastener driving apparatus 10 is provided with a sliding trigger block safety 45 for the purpose of preventing actuation of the apparatus until it is in appropriate position with respect to underlying structure. This prevents actuation of the gun until it is pressed against a surface. The safety 45 includes a bifurcated lower portion 90 which extends beneath the guide 46 for sensing elements or panels and actuating the safety. The bifurcated, or fork-like, portions 90 extend upwardly, preferably on each outer side of the magazine 28 and are joined in an upper end 91 which extends upwardly from the magazine 28. Upper end 91 is provided with a receiving opening 92 and a blocking portion 93. Also, a cut out 94 accommodates the trigger pivot 30 (see FIG. 4).

Referring now to FIG. 4, pivoted trigger 29 is secured to the gun by means of a trigger bracket 31. The trigger includes a safety lug 95 extending forwardly for engagement with blocking portion 93 of the upper end of the safety slide 45, or for extension through the opening 92 of the slide.

The safety 45 is very securely held by means of the magazine 28 cooperating with guide foot 46. Specifically, the lower bifurcated portions 90 of the slide are slidably mounted between the portions 47 and 48 of the guide foot 46 and the magazine itself, as can be seen in FIG. 6. More specifically, the bifurcated portions are slidably mounted between the guide foot 46 and the elongated guide members 52 and 53 and frames 50 and 51 with the magazine. The safety slide 45 is thus held in very secure position rearwardly of the drive station 71 and directly beneath the trigger 29.

Figure 11:
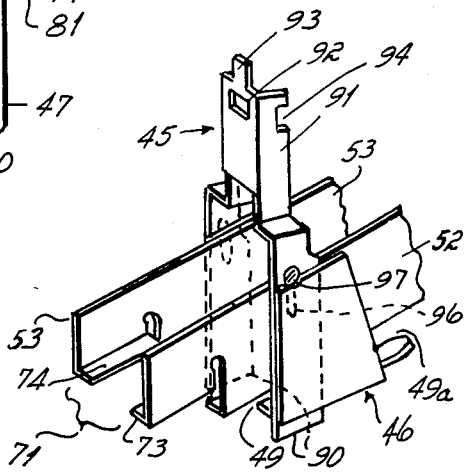
FIG. 11 is a perspective view of fastener magazine components, safety, an guide foot, as in FIG. 1, but broken away from the fastener gun for illustrative purposes.

As shown in FIGS. 4 and 11, for example, the lower portion of slide 90, on each side of the magazine 28, is provided with a slot 96 cooperating with a pin 97, slidably mounting the slide 45 to the magazine 28. Of course, it will be appreciated that the guide foot portions 47 and 48 are slightly spaced from the sides of the magazine 28 to accommodate the safety slide 45. Moreover, it will be appreciated that the lower engaging portions 90 of the slide are directly beneath the trigger pivot and safety lug areas so there is no binding or canting of the slide as it is moved between its blocking or non-blocking positions.

When the gun is moved onto an object, the bottom 90 of the slide is engaged and the slide is reciprocated upwardly so that the opening 92 is spaced across from the safety lug 95 of the trigger. At this point, the trigger can be pivoted in order to engage the pneumatic valving 32. Otherwise, when the gun is not pressed against a surface, the slide safety 45 is biased downwardly by gravity (or by any suitable spring means if such is desired), so that the blocking portion 93 is directly opposite the safety lug 95 of the trigger 29 and the trigger cannot be pivoted in order to actuate the valving 32 so as to operate the driver 42.

Also, it will be appreciated that the lower portion 90 of the safety does not extend significantly beyond the reference surfaces of the guide foot 46. As will be later explained, when the gun is used it may be advantageous to tip the gun forwardly in order to promote location of the fastener receiving post or lug. In this position, the safety could still depend below the guide foot 46 and would block the trigger 29 until the rear end of the gun was rotated back into proper orientation for fastener driving.

Finally, with respect to construction of the apparatus, it will be appreciated that the magazine 28 is attached to the nose 41 by any suitable means. For example, the forward spring housing 69 may be utilized as a mounting element for the securement of the magazine 28 to the nose 41 at the lower portion of the gun. Any other means may be utilized to accommodate the magazine to the nose, as will be appreciated by anyone of ordinary skill in the art.

Figure 9:
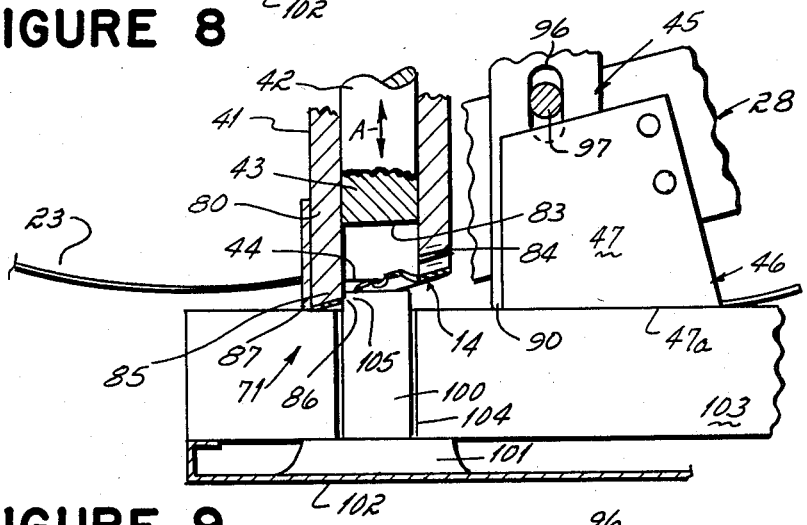
Figure 10:
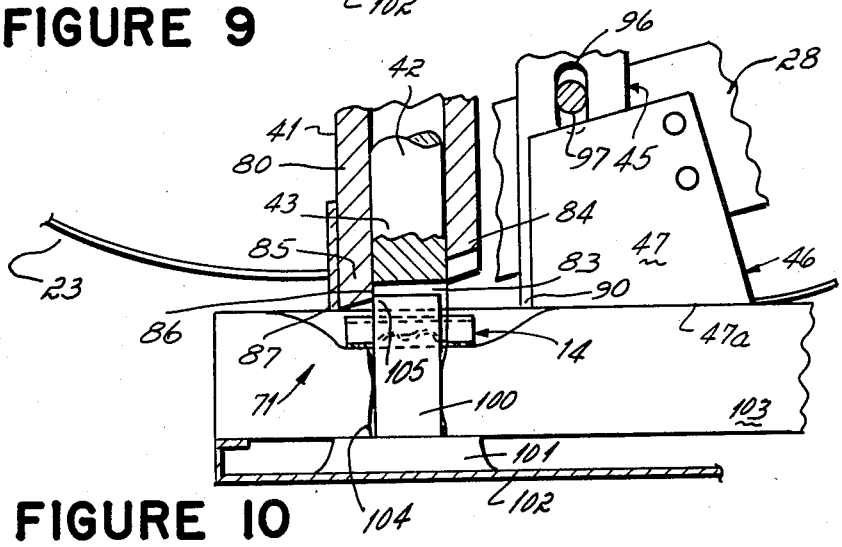

Turning now to the operation of the apparatus and fasteners as described herein, attention is directed particularly to FIGS. 8–10. As previously mentioned, the gun has a particular utility in applying fasteners to fastener receiving lugs or posts, such as the lug 100. As shown in the figures, lug 100 extends from a base 101 which is attached to, or a portion of, a panel 102. It is desirable to secure to such panel 102 another panel, cushion or element 103. In one particular example of application, panel 102 may constitute the door or body panel of an automobile and the panel 103 may constitute an interior padding or decorative panel. Panel 103 may be formed, then, of a composite of panels or elements and may be resilient foam material. In a typical operation, the panels 103 are assembled to the panels 102 with the fastener receiving lugs 100 extending upwardly through openings 104 in panels 103. After the panel 103 is so assembled, it is necessary to fasten it onto the panel 102. Fastener driving apparatus 10 and the fastener supply described herein are particularly useful for this purpose.

Once the collated fastener strip 11 has been inserted into the magazine 28 of the apparatus 10 and the follower 60 engaged behind the strip so as to push fasteners toward the set or drive station 71, the gun is picked up and manipulated to a position near the fastener receiving lug 100 to which the fastener is to be applied. FIG. 8 depicts the gun in a substantially vertical position in the vicinity of the lug 100. At this point, it will be appreciated, as shown in FIG. 8, that the lug extends in the slot 49 formed between the portions 47 and 48 of the guide foot 46. The rearward end of this slot (as indicated at **49*a* in FIG. 6**) may be flared or tapered to facilitate location of the lug by means of engaging the guide foot with it.

The gun is moved rearwardly in the direction of arrow "B" with the slot sliding past the lug 100 until the fastener driving or set station 71 is located directly over the lug 100, as shown in FIG. 9.

Returning momentarily to FIG. 8, it will be appreciated that FIG. 8 discloses the gun in a position where the lower end 90 of the safety slide 45 engages the panel 103, thus raising the safety so that the opening 92 is disposed opposite the safety lug 95 of the trigger, thereby deactivating the safety and preparing the gun for firing. Alternately, the gun may be tipped slightly forwardly to a position such that the lower end 90 does not engage the panel 103, as shown in FIG. 8, but as slightly spaced therefrom until the gun's station 71 is properly positioned over the lug 100.

Referring again to FIG. 9, the lug 100 has an upper forward corner 105 which has been engaged by the locating edge 86 of the lower end of the sleeve 80. In particular, as the gun is drawn rearwardly in the direction of arrow "B" (FIG. 8), the set station 71 is moved over the lug 100 so that the upper leg corner 105 protrudes through the opening 17 of the fastener. More particularly, the corner 105 is able to protrude through the enlarged opening 17*a* of the fastener as a result of the fastener's inclined disposition in the set station 71. If the fastener were located in a perpendicular position with respect to the driver direction "A", the spring fingers 18 could possibly prevent the lug from extending into the opening enough for engagement by the locating edge 86. The inclination of the fastener, however, makes this engagement possible.

Accordingly, in FIG. 9 the gun is now in a position for driving the fastener. The lower end 90 of the safety 45 has engaged the panel 103, deactivating the safety. The gun is in a vertical aligned position with respect to the lug 100 so that the lower end 43 of the ram can be driven downwardly with the fastener engaging faces engaging the fastener to drive it onto the lug.

It will be appreciated that the rearward portion 44*a* of the faces 44 of ram 42 first engage the fastener, such as fastener 14, due to the inclined relationship of the fastener and the direction of motion of the ram. Accordingly, this prior engagement will serve to begin rotating the fastener from an inclined to a perpendicular position such that the fastener is engaged by all fastener engaging surfaces 44 and thereafter driven perpendicularly onto the lug 100. Accordingly, the rearwardmost portion of the fastener, as positioned in the drive position 71, is first engaged and then rotated downwardly so that the whole fastener is finally perpendicular to the motion of direction "A" of the driver ram 43.

In FIG. 10, the fastener has been applied to the lug 100, the ram having extended itself to its forward-most position. The hollowed out portion 83 of the ram accommodates the top end of the lug while the lower fastener engaging faces of the ram have pushed the fastener downwardly onto the lug. Since the spring fingers 18 are inclined generally upwardly in this position, and are spaced apart a distance less than the thickness of the lug, they grasp the lug and prevent the fastener from sliding backwardly (in an upward direction as viewed in FIG. 10) so as to come off the lug.

It will be also appreciated that the panel 103 is compressible in this particular application. When the fastener 14 is driven onto the lug 100, it compresses the panel 103, and the bias placed on the fastener by the compressible panel 103 tends to retain the fastener in a properly secure engaged position on the lug 100. It will also be appreciated that the lug 100, throughout the driving operation, has been properly located with respect to both the ram 43 and the fastener 12 by means of the engagement of the top portion of the lug 100 with the locating edge 86 through the fastener 12. This greatly facilitates the proper orientation of the ram and the fastener with respect to the lug so that upon driving, the fastener is in correct register with respect to the lug.

It will also be appreciated that during the driving operation, the lower end 43 of the ram engages the fastener between the carrier strips 22 and 23 which are held by the elongated guides 73 and 74. Operation of the ram thus serves to drive the fastener away from the drive station 71, and away from the carrier strips 22 and 23, thus easily separating the fastener from the carrier strips which are retained by the guides 73 and 74.

It will also be appreciated that the extension of the lower end 43 of the ram serves to block the next fastener in the magazine from entering drive station 71 until the ram 43 is withdrawn to its retracted position, thereby permitting the next fastener to be pushed from the magazine into the drive station and to a position where it is stopped by the fastener stop 87. During this motion, the carrier strips 22 and 23 which had previously retained the fastener are simply ejected forwardly of the gun, as illustrated in FIG. 10. It is not necessary to pull or break off the carrier strips until after the last fastener is driven and the two strips are thus simply pulled from the front of the gun and discarded. It is thus unnecessary to sever the fasteners from one another or to sever the carrier strips during the application operation, or afterwards.

Accordingly, the fastener driving apparatus and fastener supply provide many advantages. The collated fastener strips are easily handled and inserted into the magazine where they are visible at all times and can be counted or inspected simply by viewing them from the bottom of the magazine. It is not necessary to join the fasteners by means of integral bridging material which is part of the fasteners themselves, or to sever the fasteners from each other, or to cut the carrier strips. Moreover, the inclination of the magazine 28 with respect to the gun facilitates maneuverability and manipulation of the gun in order to properly position the drive station with respect to a fastener receiving lug or post. The guide foot, on the other hand, serves to provide a visual reference for proper vertical position of the gun over an element and, as well, by means of a slot therein, facilitates location of a fastener receiving lug as the gun is moved into position. The inclined position of the fasteners in the drive station greatly facilitates the location of the fastener receiving lug 100 and the orientation of the ram and the fastener with respect to the lug prior to driving, by means of extension of the lug through the fastener and against a locating surface in the apparatus.

These and other advantages and modifications will be readily apparent to those of ordinary skill in the art, without departing from the scope of this invention, and the applicants intend to be bound only by the claims appended hereto.

We claim:

1. Fastener driving apparatus for driving a fastener onto a fastener receiving member, and including:

a reciprocating fastener driver means movable in a drive path;

a fastener magazine means for feeding fasteners serially to a drive position beneath said driver means from where they can be driven onto a fastener receiving member;

said magazine means inclined at an acute angle with respect to the direction of movement of said driver means;

a guide foot extending beneath said magazine laterally of said drive position and having a reference surface in a plane perpendicular to the direction of reciprocation of said driver means, said guide foot including slot means in said reference surface spaced outside said drive path for receiving a fastener receiving member and for guiding said apparatus with respect to said member; and means for moving said driver means to drive a fastener onto a fastener receiving member.

2. Fastener driving apparatus as in claim 1, including a fastener stop disposed on a side of said driver means opposite said magazine means for stopping fasteners in a drive position beneath said driver means in a position to be driven.

3. Fastener driving apparatus as in claim 2, wherein said fastener drive position is disposed on an incline at the same acute angle, with respect to the direction of movement of said driver means, as the acute angle of incline of said magazine means with respect to the direction of movement of said driver means.

4. Fastener driving apparatus as in claim 3, wherein said driver means includes at least one forward fastener engaging and driving surface lying in a plane perpendicular to the direction of movement of said driver means.

5. Fastener driving apparatus as in claim 2, wherein said driver means includes a front plate having a rear edge means disposed between said fastener stop and said magazine means, said rear edge means for locating a fastener receiving member beneath a fastener in said drive position prior to driving said fastener thereon.

6. Fastener driving apparatus as in claim 1, wherein said magazine means includes a longitudinal slot on a bottom surface thereof, providing visual access therein for inspection of fasteners.

7. Fastener driving apparatus as in claim 1, wherein said apparatus includes magnetic means disposed above said drive position for releasably holding fasteners in said drive position.

8. Apparatus for driving fasteners onto fastener receiving members from a fastener supply including elongated, parallel flexible fastener carrier strips engaging one side of said fasteners and securing said fasteners in an aligned disposition and respectively overlying and extending laterally outwardly beyond outer edges of said fasteners, in non-interfering relationship with a drive path of said fasteners, said driving apparatus including:

a reciprocal driver means movable in a drive path, said driver means engaging said one side of a fastener and driving a fastener from a drive position through a fastener drive path onto a fastener receiving member;

a magazine means for feeding fasteners along a fastener feed path seriatim to said drive position; and means for holding a fastener in said drive position beyond said magazine means;

said magazine means including first elongated fastener engaging guides for engaging and guiding fasteners in said magazine;

said means for holding a fastener in said drive position including second elongated guides for slidably receiving and holding elongated carrier strips of a fastener supply, beyond said magazine means at said drive position and outwardly of both said driver drive path and said fastener drive path, to permit said driver means to drive fasteners from said carrier strips without passing a fastener through a carrier strip.

9. Apparatus for driving fasteners onto fastener receiving members as in claim 8, wherein said means for holding fasteners in said drive position include magnets disposed above said fastener path and adjacent said driver means.

10. Apparatus for driving fasteners onto fastener receiving members as in claim 9, wherein said magnets are disposed in a position to bias fasteners upwardly in an area between the first guide and the second elongated guides at the drive position.

11. Apparatus for driving fasteners onto fastener receiving members as in claim 8, said apparatus further including locating means disposed above said drive position for abutting and locating a top portion of a fastener receiving means, extending from below said fastener path, with respect to said driver means and with respect to said fastener drive position.

12. Fastener driving apparatus for driving a fastener having a flat drive surface onto a fastener receiving member, and including:

a reciprocable fastener driver means mounted for movement to engage and drive flat drive surfaces of fasteners to be driven;

means defining an inclined fastener drive position under said driver means and for holding a fastener beneath said driver means with flat drive surfaces of the fasteners disposed at an acute angle to a direction of drive movement of said driver means;

a fastener magazine means for feeding fasteners serially to said inclined drive position with respect to and beneath said driver means from where they can be driven from an inclined position onto a fastener receiving member;

said magazine means inclined at said acute angle with respect to a direction of movement of said driver means;

said fastener magazine means for feeding fasteners into said inclined drive position at said acute angle; and means for moving said driver means to drive a fastener onto a fastener receiving member in a direction parallel to motion of said fastener driving means;

said driver means engaging and rotating a fastener, while driving a fastener such that said flat drive surface rotates to a position substantially perpendicular to said direction of movement.

13. Fastener driving apparatus as in claim 12, wherein said driver means includes a forward face comprising fastener engaging surfaces disposed in a plane perpendicular to said direction of movement of said driver means.

14. Fastener driving apparatus as in claim 13, wherein said apparatus has forward and rearward ends, and wherein a rearward portion of said fastener engaging surfaces of said driver means are disposed to engage a rear portion of the flat drive surface of any fastener in said inclined drive position prior to engagement of other portions of a fastener by said driver means, whereby said driver means rotates fasteners from said inclined drive position to a position substantially perpendicular to said direction of movement.

15. Fastener driving apparatus as in claim 12, further including locating means for engaging a fastener receiving lug extending upwardly through said drive position toward said driver means.

16. Fastener driving apparatus for driving a fastener from a fastener supply onto a fastener receiving member for securing an element thereto, said fastener supply including elongated, parallel flexible fastener carrier strips securing said fasteners in an aligned disposition and respectively overlying and extending laterally outwardly beyond outer edges of said fasteners, and said driving apparatus including:

a driver means for driving fasteners from a drive position onto a fastener receiving member;

a fastener magazine means for feeding fasteners serially to a drive position beneath said driver means and beyond said magazine means from where they can be driven onto a fastener receiving member;

means for holding fasteners in said drive position beyond said magazine means;

said magazine means inclined at an acute angle with respect to the direction of movement of said driver means;

said magazine means including first elongated fastener engaging guides for engaging and guiding fasteners in said magazine;

said means for holding fasteners in said drive position including second elongated guides for slidably receiving and holding elongated carrier strips of said fastener supply beyond said magazine means and outwardly of any fasteners thereon, to permit fasteners to be driven from said carrier strips;

a guide foot extending beneath said magazine and having a reference surface in a plane perpendicular to the direction of reciprocation of said driver means;

means for moving said driver means to drive a fastener onto a fastener receiving member;

trigger means for actuating said moving means; and safety means for preventing actuation of said trigger means and said driver means until said fastener driving apparatus is disposed in contact with an element to be secured.

17. Fastener driving apparatus for driving a fastener from a fastener supply onto a fastener receiving member for securing an element thereto, said fastener supply including elongated, parallel flexible fastener carrier strips securing said fasteners in an aligned disposition and respectively overlying and extending laterally outwardly beyond outer edges of said fasteners, and including:

a driver means for driving fasteners from a drive position onto a fastener receiving member;

a fastener magazine means for feeding fasteners serially to a drive position beneath said driver means and beyond said magazine means from where they can be driven onto a fastener receiving member;

means for holding fasteners in said drive position beyond said magazine means;

said magazine means inclined at an acute angle with respect to the direction of movement of said driver means;

said magazine means including first elongated fastener engaging guides for engaging and guiding fasteners in said magazine;

said means for holding fasteners in said drive position including second elongated guides slidably for receiving and holding elongated carrier strips of said fastener supply, beyond said magazine means and outwardly of any fasteners, to permit fasteners to be driven from said carrier strips;

a guide foot extending beneath said magazine and having a reference surface in a plane perpendicular to the direction of reciprocation of said driver means; and means for moving said driver means to drive a fastener onto a fastener receiving member.

18. In combination, apparatus for driving fasteners onto fastener receiving members, and a collated fastener supply within said apparatus, said collated fastener supply including:

a plurality of fasteners having respective outer side edges;

a plurality of parallel flexible carrier strips releasably securing said fasteners in an aligned disposition;

said strips respectively overlying said fasteners and extending laterally outwardly beyond respective outer side edges of said fasteners; and said apparatus including:

a reciprocal driver means movable in a drive path for driving said fasteners from a drive position in said apparatus onto a fastener receiving member;

a magazine means for feeding said fasteners along a fastener path seriatim to said drive position; and means for holding fasteners in said drive position beyond said magazine means;

said magazine means including first elongated fastener engaging guides for engaging and guiding fasteners in said magazine; and said means for holding fasteners in said drive position including second elongated guides for slidably receiving and holding said flexible carrier strips beyond said magazine means at said drive position and outwardly of said fasteners and said drive path, to permit said driver means to drive fasteners from said carrier strips and from said apparatus.

* * * * *